US011976547B2

(12) United States Patent
Hall et al.

(10) Patent No.: US 11,976,547 B2
(45) Date of Patent: May 7, 2024

(54) BOLT-ON WIRELESS VIBRATION SENSOR ASSEMBLY

(71) Applicant: Nabors Drilling Technologies USA, Inc., Houston, TX (US)

(72) Inventors: James M. Hall, Spring, TX (US); Jose Abelardo Sanchez, Richmond, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 17/305,781

(22) Filed: Jul. 14, 2021

(65) Prior Publication Data

US 2022/0056797 A1 Feb. 24, 2022

Related U.S. Application Data

(60) Provisional application No. 63/067,180, filed on Aug. 18, 2020.

(51) Int. Cl.
*E21B 47/01* (2012.01)
*E21B 47/16* (2006.01)

(52) U.S. Cl.
CPC ..... *E21B 47/01* (2013.01); *E21B 47/16* (2013.01)

(58) Field of Classification Search
CPC ..... E21B 47/01; E21B 47/16; E21B 47/00
See application file for complete search history.

(56) References Cited

U.S. PATENT DOCUMENTS

| | | | | |
|---|---|---|---|---|
| 9,133,668 | B2 | 9/2015 | Cardellini et al. | |
| 2003/0226662 | A1* | 12/2003 | Linyaev | E21B 47/01 166/250.11 |
| 2004/0145970 | A1* | 7/2004 | Dopf | E21B 47/16 340/856.3 |
| 2005/0024231 | A1* | 2/2005 | Fincher | E21B 47/135 340/854.4 |
| 2006/0115335 | A1* | 6/2006 | Allen | E21B 47/001 405/274 |
| 2014/0177392 | A1* | 6/2014 | Patterson | E21B 47/16 367/82 |
| 2018/0058209 | A1* | 3/2018 | Song | G01F 1/74 |
| 2019/0128114 | A1* | 5/2019 | Bryant | E21B 47/06 |
| 2021/0063237 | A1* | 3/2021 | Päivinen | G01P 15/00 |
| 2021/0270125 | A1* | 9/2021 | Smith | E21B 47/08 |
| 2022/0034174 | A1* | 2/2022 | Gooneratne | E21B 47/26 |

* cited by examiner

*Primary Examiner* — Blake Michener
*Assistant Examiner* — Yanick A Akaragwe
(74) *Attorney, Agent, or Firm* — Abel Schillinger, LLP

(57) ABSTRACT

A system for detecting acoustic or vibration signals transmitted along a tubular string, the system can include a tool assembly with a sensor assembly configured to be removably attached to a sub, the sub being connected to the tubular string such that acoustic/vibration signals travel through the sub and the sensor assembly detects the signals, with the sensor assembly including sensors that are configured to contact the sub and detect the signals traveling through the sub.

20 Claims, 10 Drawing Sheets

SECTION LINE 9-9

BOLT-ON WIRELESS VIBRATION SENSOR ASSEMBLY

CROSS-REFERENCE TO RELATED APPLICATION(S)

This application claims priority under 35 U.S.C. § 119(e) to U.S. Patent Application No. 63/067,180, entitled "BOLT-ON WIRELESS VIBRATION SENSOR ASSEMBLY," by James M. HALL et al., filed Aug. 18, 2020, which application is assigned to the current assignee hereof and incorporated herein by reference in its entirety.

TECHNICAL FIELD

The present invention relates, in general, to the field of drilling and processing of wells. More particularly, present embodiments relate to a system and method for receiving vibration/acoustic signals from a tubular string and wirelessly communicating sensor data to rig equipment during subterranean operations.

BACKGROUND

During subterranean operations, such as drilling or producing, vibration signals (or acoustic signals) can be generated by a drill bit interacting with the earthen formation, worn bearings, noisy motors, unbalanced rotation of drive shafts, movement of tubular string in wellbore, oscillations in tubular string, etc. The vibration signals can be transmitted through the tubular string from the vibration source (e.g., a drill bit) to the surface. However, detecting the vibration signals from a rotating tubular string and reporting these signals can present some unique challenges. Therefore, improvements in detecting vibration (or acoustic) signals from a tubular string are continually needed.

SUMMARY

One general aspect includes a system for detecting vibration signals in subterranean operations a tool assembly may include: a sub; and a vibration sensor assembly, with the vibration sensor assembly being configured to be removably attached to an outer surface of the sub (e.g., a crossover sub, a lower well control valve, etc.), the vibration sensor assembly may include: one or more sensors configured to detect vibration signals transmitted through a tubular string, where the one or more sensors extend radially inward past an innermost surface of the vibration sensor assembly and are configured to engage the outer surface of the sub.

One general aspect includes a method for detecting vibration signals in subterranean operations. The method can include removably attaching a vibration sensor assembly to a sub proximate a top end of a tubular string in a wellbore; radially extending one or more sensors of the vibration sensor assembly past an innermost surface of the vibration sensor assembly toward the sub, engaging the one or more sensors with an outer surface of the sub, and detecting vibration signals carried by the tubular string via the one or more sensors.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. It should be understood that the various embodiments described herein are not mutually exclusive. The elements in one embodiment can also be used in other embodiments.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "tubular string."

Figure 1:
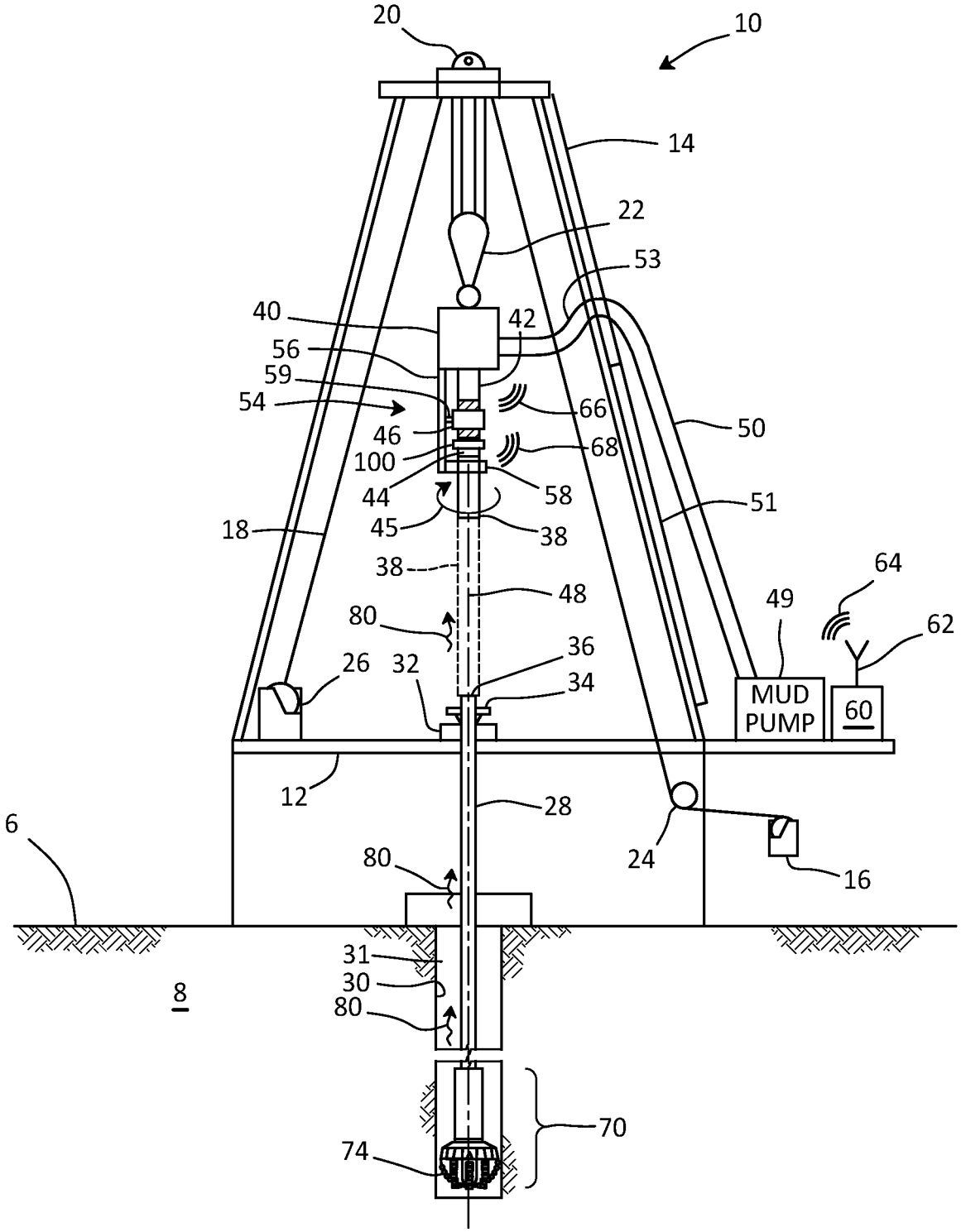
FIG. 1 is a representative partial cross-sectional view of a rig during a drilling operation with a downhole device communicating to the surface, in accordance with certain embodiments.

Turning now to the drawings, FIG. 1 is a schematic of a drilling rig 10 in the process of drilling a well, in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a tubular string 28 extends downward into a wellbore 30 and is held stationary with respect to the rig floor 12 by a rotary table 32 and slips 34. A portion of the tubular string 28 extends above the rig floor 12, forming a stickup 36 to which another length of tubular 38 may be added.

When a new length of tubular 38 is added to the tubular string 28, a top drive 40, hoisted by the traveling block 22, positions the tubular 38 above the wellbore 30 before coupling with the tubular string 28. The top drive can utilize a grabber system 54 to hold the tubular 38 while the top drive 40 is coupled to the tubular. The grabber system 54 may include a grabber leg 56 coupled to the top drive 40, a grabber box 58 coupled to the end of the grabber leg 56 and configured to grab the tubular 38, and a mud saver valve support 59 configured to couple a mud saver valve 46 to the grabber leg 56.

The top drive 40, once coupled with the tubular 38, may then lower the coupled tubular 38 toward the stickup 36 such that the tubular 38 connects with the stickup 36 and becomes part of the drill string 28. As the tubular 38 is lowered, the top drive 40 may rotate the tubular 38 (arrows 45). Specifically, the top drive 40 includes a quill 42, a mud saver valve 46, and a saver sub 44 (e.g., a crossover sub), used to turn the tubular 38. The tubular 38 may be coupled to the saver sub 44, which is coupled to the mud saver valve 46, which is in turn coupled to the top drive 40 via the quill 42. In certain embodiments, the mud saver valve 46 may include threads on both axial ends to couple to the saver sub 44 and the quill 42.

Further, the top drive 40 can couple with the tubular 38 in a manner that enables translation of motion to the tubular 38. Indeed, in the illustrated embodiment, the top drive 40 is configured to supply torque for making-up and unmaking a coupling between the tubular 38 and the stickup 36. However, torque for making-up and unmaking a coupling between the tubular 38 and the stickup 36 can alternatively, or in addition to, be supplied by other equipment, such as a pipe handler (not shown) or an iron roughneck (not shown).

To facilitate the circulation of mud or other drilling fluid within the wellbore 30, the drilling rig 10 includes a mud pump 49 configured to pump mud or drilling fluid up to the top drive 40 through a mud hose 50. In certain embodiments, the mud hose 50 may include a stand pipe 51 coupled to the derrick 14 in a substantially vertical orientation to facilitate pumping of mud. The stand pipe 51 provides a high-pressure path for mud to flow up the derrick 14 to the top drive 40. From the mud hose 50 (e.g., stand pipe 51), the mud flows through a kelly hose 53 to the top drive 40. From the top drive 40, the drilling mud will flow through internal passages of the mud saver valve 46, into internal passages of the tubular 38 and the tubular string 28, and into the wellbore 30 to the bottom of the well. The drilling mud flows within the wellbore 30 (e.g., in an annulus 31 between the tubular string 28 and the wellbore 30) and back to the surface where the drilling mud may be recycled (e.g., filtered, cleaned) and pumped back up to the top drive 40 by the mud pump 49.

When a new length of tubular 38 is to be added to the tubular string 28, mud flow from the mud pump 49 and the mud hose 50 can be stopped, and the top drive 40 can be removed from the tubular string 28 (i.e., from the length of tubular 38 most recently added to the tubular string 28). When the top drive 40 releases the tubular string 28, mud within the top drive 40 may run out of the top drive 40 and onto the rig floor 12. To avoid spilling mud onto the rig floor 12, the mud saver valve 46 can be included to block mud from inadvertently flowing out of the top drive 40 when the mud pump 49 is not pumping mud. When the top drive 40 is thereafter coupled to a new length of tubular 38 and the mud pump 49 resumes a pumping operation, the mud saver valve 46 may enable flow of mud through the mud saver valve 46 and the top drive 40 to the tubular 38 and tubular string 28.

The rig controller 60 may be configured to regulate operation of the mud pump 49 or other features of the drilling rig 10. For example, the rig controller 60 may be configured to regulate a flow rate of mud or other drilling fluid circulated through the tubular string 28 and the wellbore 30 during installation of tubular elements (e.g., tubular 38). For example, the rig controller 60 may regulate operation of the mud pump 49 to start, stop, increase, and/or decrease mud flow into the tubular string 28 and wellbore 30 during installation of tubular 38 elements. The rig controller 60 can also receive sensor data from surface and downhole sensors. For example, the rig controller 60 may receive wirelessly transmitted data from the vibration sensor assembly 100, which can detect vibration signals traveling through the tubular string 28.

The tubular string 28 can include a bottom hole assembly BHA 70 that can include a drill bit 74. In operation, such as rotating the tubular string 28 during drilling, vibration (or acoustic) signals 80 can be received into the tubular string 28 and transmitted through the tubular string 28 with it acting as a communications medium. Challenges may arise in detecting the signals 80 while the tubular string 28 is rotating in the wellbore 30 (such as while drilling) and then communicating the detected signal information to surface equipment (e.g., the rig controller 60).

The current disclosure provides a novel vibration sensor assembly 100 that can be removably attached to an existing tubular device (e.g., a saver sub 44) at the top drive 40 and detect the vibration (or acoustic) signals 80 in the tubular string 28. The sensor assembly 100 can minimize signal loss between the tubular string 28 and the sensors of the sensor assembly 100. The sensor assembly 100 can include wireless communication electronics that can transmit the sensor data (or data that is representative of the vibration signals) via wireless signals 68 to external equipment, such as the top drive 40 or the rig controller 60. The top drive 40 can receive the wireless signals 68 and retransmit the sensor data, communicated in the wireless signals 68, via wireless signals 66 from the top drive to other equipment such as the rig controller 60. The top drive 40 can be wired to the rig controller 60 for data transmission or connected via wireless communications to the rig controller 60 for data transmission. The top drive 40 can also perform preprocessing on the sensor data before communicating the results to the rig controller 60. The rig controller 60 can include an antenna 62 that can be used to receive the wireless signals 66, 68 or transmit wireless signals 64 providing two-way wireless communication between the rig controller 60 and the other rig equipment (e.g., sensor assembly 100, top drive 40, etc.).

It should be noted that the illustration of FIG. 1 is intentionally simplified to focus on the vibration measurement system, and in particular the vibration sensor assembly 100 (described in more detail below) that can be positioned on a saver sub 44 near the top drive 40. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
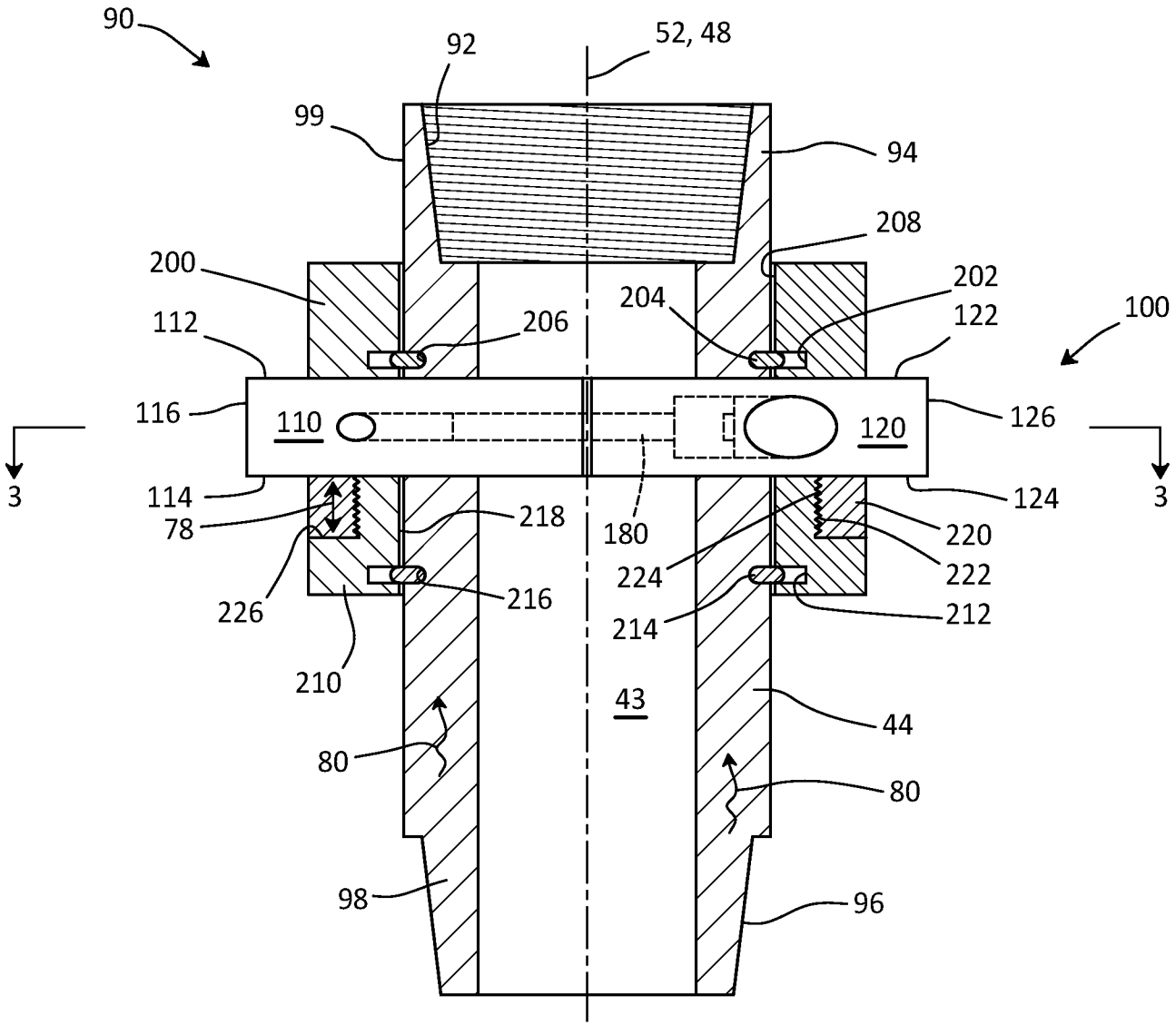
FIG. 2 is a representative partial cross-sectional view of a sub with a bolt-on vibration sensor assembly, in accordance with certain embodiments.

FIG. 2 is a representative partial cross-sectional view of a tool assembly 90 that can include a sub 44 with a bolt-on sensor assembly 100 removably attached thereon. The sub 44 can include a box end 94 with internal threads 92 and a pin end 98 with external threads 96. The sub 44 can also include an internal flow passage 43 with a central axis 52 that can align with the central axis 48 of the tubular string 28. The threaded ends 94, 98 can be used to connect the sub to the top drive 40 and the tubular string 28. The sub 44 is merely one example of a sub that can be used to carry the sensor assembly 100 and transfer the signals 80 from the tubular string 28 to the sensor assembly 100. The sensor assembly 100 can include two arcuate segments 110, 120 that can be removably connected to each other (e.g., via a threaded fastener 180) to form a circular ring around a sub 44. As used herein, the term "sub" refers to any cylindrical object that can be connected to the tubular string 28 such that it can receive the signals 80 and transfer the signals 80 to the sensor assembly 100. The sensor assembly 100 can be held in an axial position on the sub 44 by an upper retainer ring 200 positioned axially above the sensor assembly 100 and a lower retainer ring 210 positioned axially below the sensor assembly 100, thereby restraining the sensor assembly 100 at an axial position on the sub 44.

The upper retainer ring 200 can provide an annular space between an inner surface 208 of the upper retainer ring 200 and an outer surface 99 of the sub 44. A keeper ring 204 can be used to lock the upper retainer ring 200 at an axial position along the sub 44. When the upper retainer ring 200 is positioned at the axial location, the keeper ring 204 can radially retract from a recess 202 in the upper retainer ring 200 into a recess 206 formed in the outer surface 99 of the sub 44. When it is desirable to remove the upper retainer ring 200 from the sub, an extraction tool (not shown) can be used to radially expand the keeper ring 204 out of the recess 206 and back into the recess 202. The recess 206 can be formed in the outer surface 99 by cutting a groove at least partially around the circumference of the outer surface 99.

The lower retainer ring 210 can provide an annular space between an inner surface 218 of the lower retainer ring 210 and an outer surface 99 of the sub 44. A keeper ring 214 can be used to lock the lower retainer ring 210 at an axial position along the sub 44. When the lower retainer ring 210 is positioned at the desired axial location, the keeper ring 214 can radially retract from a recess 212 in the lower retainer ring 210 into a recess 216 formed in the outer surface 99 of the sub 44. When it is desirable to remove the lower retainer ring 210 from the sub 44, an extraction tool (not shown) can be used to radially expand the keeper ring 214 out of the recess 216 and back into the recess 212. The recess 216 can be formed in the outer surface 99 by cutting a groove at least partially around the circumference of the outer surface 99.

The lower retainer ring 210 can include an adjustment ring 220 with inner threads 224 that can be threadingly engaged with outer threads 222 of the lower retainer ring 210. The adjustment ring 220 can be disposed between an annular shoulder 226 of the lower retainer ring 210 and lower surfaces 114, 124 of the sensor assembly 100. When the adjustment ring 220 is rotated about the central axis 52 of the tool 90 relative to the lower retainer ring 210, the adjustment ring 220 will move axially up or down (arrows 78) depending upon the direction of rotation. The central axis 52 can be aligned with the central axis 48 of the tubular string 28 when the tool 90 is assembled to the tubular string 28. When the adjustment ring 220 is axially extended toward the sensor assembly 100, the adjustment ring 220 can engage the surfaces 114, 124 of the respective arcuate segments 110, 120 of the sensor assembly 100. Upward axial movement of the adjustment ring 220 into engagement with the sensor assembly 100 can cause the sensor assembly 100 to also engage the upper surfaces 112, 122 of the sensor assembly 100 with the upper retainer ring 200, thereby applying an axial compression force to the sensor assembly 100 from the lower retainer ring 210 and an equal and opposite compression force from the upper retainer ring 200. The opposing compression forces can act to restrict axial movement of the sensor assembly 100 along the sub 44 during operation.

Figure 3:
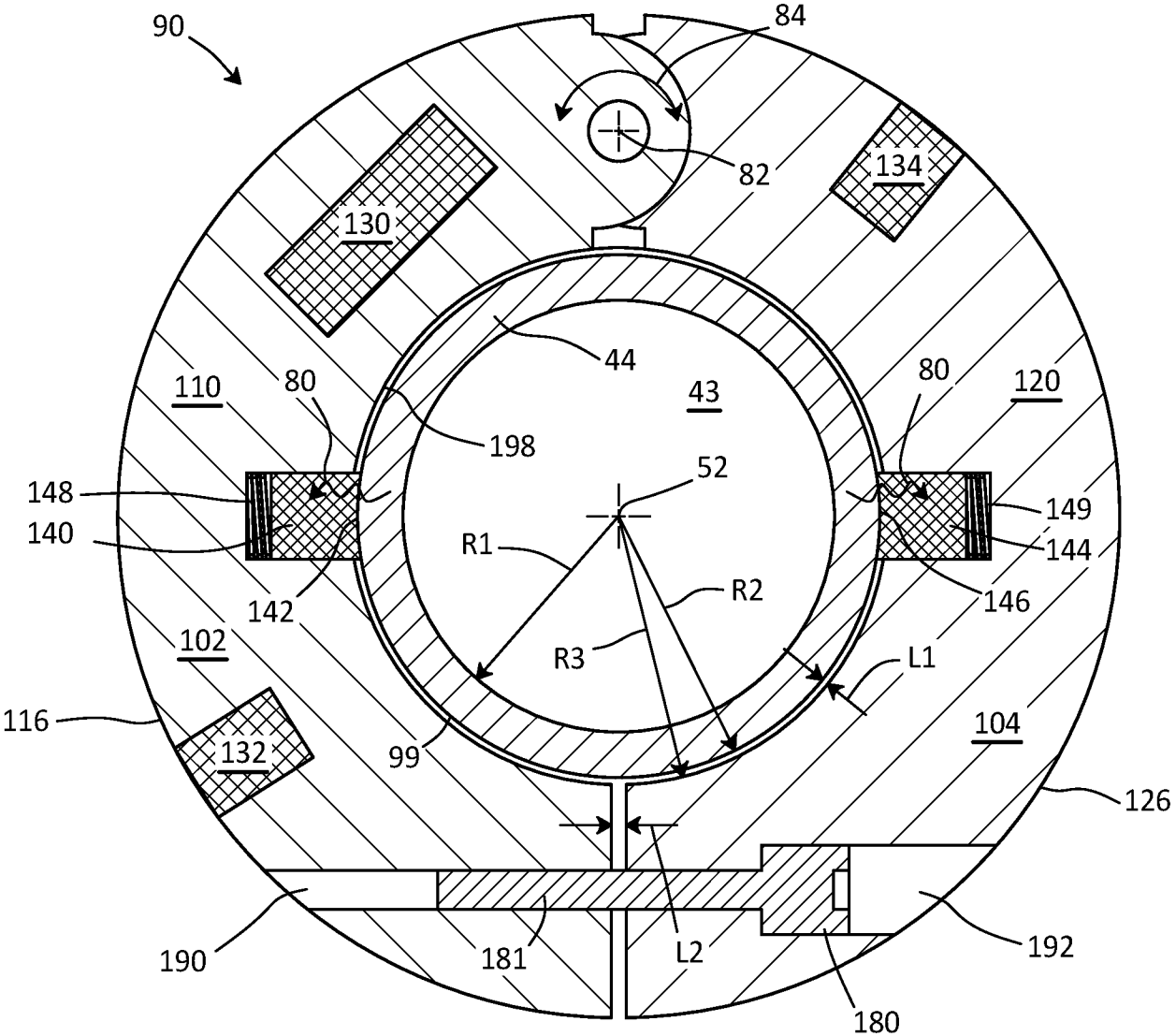
FIG. 3 is representative partial cross-sectional view of a bolt-on vibration sensor assembly, in accordance with certain embodiments.

FIG. 3 is a representative partial cross-sectional view generally along cross-section line 3-3 of a tool assembly 90, according to one or more embodiments. The tool assembly 90 can include the sub 44 and the sensor assembly 100. The sensor assembly 100 can include two arcuate segments 110, 120 that can be rotationally coupled to each other at pivot 82. Therefore, the segment 120 can be rotated (arrows 84) toward the segment 110 to encircle the sub 44 in a closed position or rotated away from the segment 110 to an open position to remove the sensor assembly 100 from the sub 44. When the segment 120 is rotated toward the segment 110, a fastener 180 can be inserted through an opening 192 in the segment 120 and threaded into a threaded opening 190 in the segment 110. It should be understood that the opening 192 can be in the segment 110 and the threaded opening 190 can be in the segment 120. It is not a requirement that the fastener 180 be installed through the segment 120 and threaded into segment 110.

The sensor assembly 100 can include electronics 130, one or more antennas 132, a power source 134, and one or more sensors 140, 144 housed in the respective bodies 102, 104 of one or more segments 110, 120 (i.e., the vibration sensor assembly 100). The sensors 140, 144 can detect the vibration or acoustic signals 80 transmitted through the tubular string 28 to the sub 44. The sensors 140, 144 can be communicatively coupled to the electronics 130, which can receive sensor data from the sensors 140, 144 and can save the sensor data in a non-transitory memory. The electronics 130 can include one or more processors coupled to the non-transitory memory for storing the sensor data, processing the sensor data, and executing program instructions stored in the non-transitory memory.

The power source 134 can be configured to provide necessary energy to power the electronics 130, the sensors 140, 144, and the one or more antennas 132. The power source 134 can be a battery (e.g., lithium-ion battery, etc.) or any other energy storage device that can be used to power the sensor assembly 100.

The one or more antennas 132 can be communicatively coupled to the one or more processors in the electronics 130 and can be used to wirelessly communicate to other rig equipment external to the sensor assembly 100 (such as top drive 40, rig controller 60, etc.). The sensors 140, 144 can be compressed into direct coupling or contact with the outer surface 99 of the sub 44. Direct engagement 142, 146 of the respective sensors 140, 144 to the sub 44 provides a direct transfer of the signals 80 to the sensors 140, 144 which can maximize sensitivity of the sensors 140, 144 to the signals 80 traveling in the sub 44, this can improve sensitivity over configurations that may have sensors embedded in a body, where the body makes contact with the sub and transfers the signals 80 to the sensors through the body, thereby causing the signals 80 to travel through another medium (i.e., the body) before being detected by the sensors.

The sub 44 can have an internal radius R1 relative to the central axis 52 and an external radius R2 relative to the central axis 52. The sensor assembly 100, when in a closed position can have an internal radius R3. The difference between the radius R2 and the radius R3 can be represented as a gap L1. The gap L1 is a distance between the outer surface 99 of the sub 44 and the innermost surface 198 of the sensor assembly 100. The innermost surface 198 is the inner cylindrical surface of the sensor assembly 100 that is the closest to the central axis 52, excluding the sensors 140, 144. The sensors 140, 144 can extend radially inward toward central axis 52 past the innermost surface 198 of the sensor assembly 100. When the segment 120 is rotated into a closed position shown in FIG. 3 relative to the segment 110, the fastener 180 can be installed to maintain the sensor assembly 100 segments 110, 120 in the closed position. With the fastener 180 installed to a desired torque, then a gap L2 may remain between the segments 110, 120. The sensors 140, 144 can engage the sub 44 at respective engagements 142, 146 by extending from the sensor assembly 100 through the gap L1 and into engagement with the outer surface 99 of the sub 44. As stated above, the direct contact or coupling of the sensors 140, 144 to the sub 44 can provide maximum sensitivity of the sensors 140, 144 to the signals 80 in the sub 44.

Even though biasing devices may not be required, the sensors 140, 144 can each have a biasing device 148, 149, respectively, that can ensure maximum compression of the sensors 140, 144 against the sub 44 at the engagements 142, 146 and help prevent exceeding a maximum compression of the sensors 140, 144 against sub 44. The biasing devices 148, 149 can be disposed between the respective sensor 140, 144 and a body 102, 104 of the segments 110, 120, respectively. The biasing devices 148, 149 can be materials that maintain a compression force of the sensors 140, 144 against the sub 44. It should be understood that the biasing devices 148, 149 are not required and the sensors 140, 144 can be installed in the segments 110, 120 such that they extend from the innermost surface 198 of the sensor assembly 100 to engage the sub 44, with the torque applied to the fastener 180 used to control compression forces of the sensors 140, 144 against the sub 44. A retaining means can be used by each of the sensors 140, 144 to retain the respective sensors 140, 144 in the sensor assembly 100.

Figure 4:
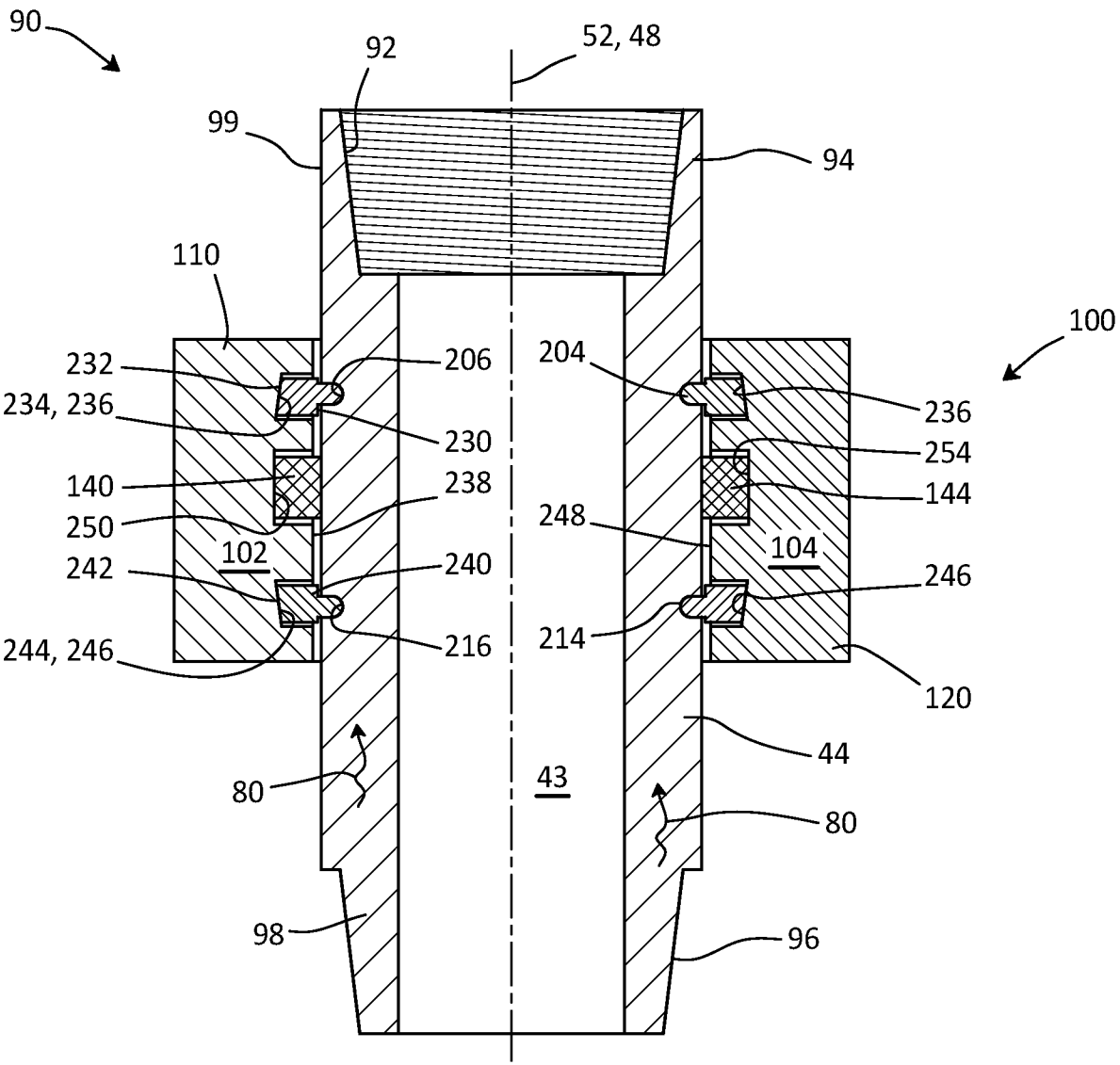
FIG. 4 is a representative partial cross-sectional view of a sub with a bolt-on vibration sensor assembly, in accordance with certain embodiments.

FIG. 4 is a representative partial cross-sectional view of a tool 90 that can include a sub 44 with a bolt-on vibration sensor assembly 100 removably attached thereon. The sub 44 can include a box end 94 with internal threads 92 and a pin end 98 with external threads 96. The sub 44 can also include an internal flow passage 43 with a central axis 52 that can align with the central axis 48 of the tubular string 28. The threaded ends 94, 98 can be used to connect the sub to the top drive 40 and the tubular string 28. The sub 44 is merely one example of a sub that can be used to carry the sensor assembly 100 and transfer the signals 80 from the tubular string 28 to the sensor assembly 100. As in FIG. 2, the sensor assembly 100 can include two arcuate segments 110, 120 that can be removably connected to each other (e.g., via a threaded fastener 180 not shown, refer to FIG. 2)) to form a circular ring around a sub 44 (or any other cylindrical object that is connected to the tubular string 28 such that it can receive the signals 80 and transfer the signals 80 to the sensor assembly 100). The sensor assembly 100 can be held in an axial position on the sub 44 by a snap ring retainer 230 positioned axially above the sensors 140, 144 and a lower snap ring retainer 240 positioned axially below the sensors 140, 144.

The arcuate segments 110, 120 can be rotationally attached to each other at pivot 82 as in FIG. 3, and rotatable between closed and open positions. When in the closed position a bolt 180 can be installed to maintain the arcuate segments 110, 120 in the closed position around the sub 44. The snap ring retainer 230 can include a rounded end protrusion 204 that can be positioned in an annular groove 206 in the outer surface 99 of the sub 44. The rounded end of the protrusion 204 can engage the complimentarily shaped annular groove 206 such that when the snap ring retainer 230 is pressed into engagement with the annular groove 206, the snap ring 230 is axially centered relative to the groove 206. Similarly, the snap ring retainer 240 can include a rounded end protrusion 214 that can be positioned in an annular groove 216 in the outer surface 99 of the sub 44. The rounded end of the protrusion 214 can engage the complimentarily shaped annular groove 216 such that when the snap ring retainer 240 is pressed into engagement with the annular groove 216, the snap ring 240 is axially centered relative to the groove 206.

The arcuate segments 110, 120 can have a respective recess 236, 246 formed in an inner surface 238, 248 of each respective segment 110, 120, such that when the arcuate segments 110, 120 are rotated to the closed position, the segments 110, 120 form annular recesses 236, 246. When the arcuate segments 110, 120 are rotated to their closed position, the snap ring retainers 230, 240, which were installed on the sub 44 prior to closing the sensor assembly 100, can be received in respective annular grooves 236, 246. In the closed position, the sensor assembly 100 is retained in the desired axial position by the snap ring retainers 230, 240 by engagement with the respective annular grooves 206, 216, and the annular recesses 236, 246.

The annular recess 236 can have an engagement surface 234 that is tapered in a first direction relative to the central axis 52 of the sub 44. The engagement surface 234 can be configured to engage with a complimentarily shaped engagement surface 232 of the snap ring retainer 230, with the surface 232 being tapered in the first direction relative to the central axis 52. The annular recess 246 can have an engagement surface 244 that is tapered in a second direction relative to the central axis 52, the second direction being opposite to the first direction. The engagement surface 244 can be configured to engage with a complimentarily shaped engagement surface 242 of the snap ring retainer 240, with the surface 242 being tapered in the second direction relative to the central axis 52.

When the fastener 180 is installed to hold the arcuate segments 110, 120 in the closed position (e.g., sensor assembly 100 of FIG. 3), the arcuate segments 110, 120 can be compressed onto the snap ring retainers 230, 240. The compression of the oppositely tapered surfaces 234, 244 onto the respective tapered surfaces 232, 242 of the snap ring retainers 230, 240, the body 102 of the segment 110, and the body 104 of the segment 120 can be compressed or tensioned depending upon which direction the tapered surfaces 232, 242, 234, 244 are tapered. This can act to positively retain the segments 110, 120 in a desired axial location on the sub 44 while reducing or eliminating noise caused by loose retaining forces.

The sensors 140, 144 can be installed in respective recesses 250, 254 in the inner surfaces 238, 248 of the segments 110, 120. The sensors 140, 144 can be extended radially toward the central axis 52 past the respective inner surfaces 238, 248 and into direct contact or coupling with the sub 44. The sensor assembly 100 can also have a biasing device 148, 149 between the respective sensor 140, 144 (not shown, see FIG. 3) and the respective recess 250, 254.

Figure 5:
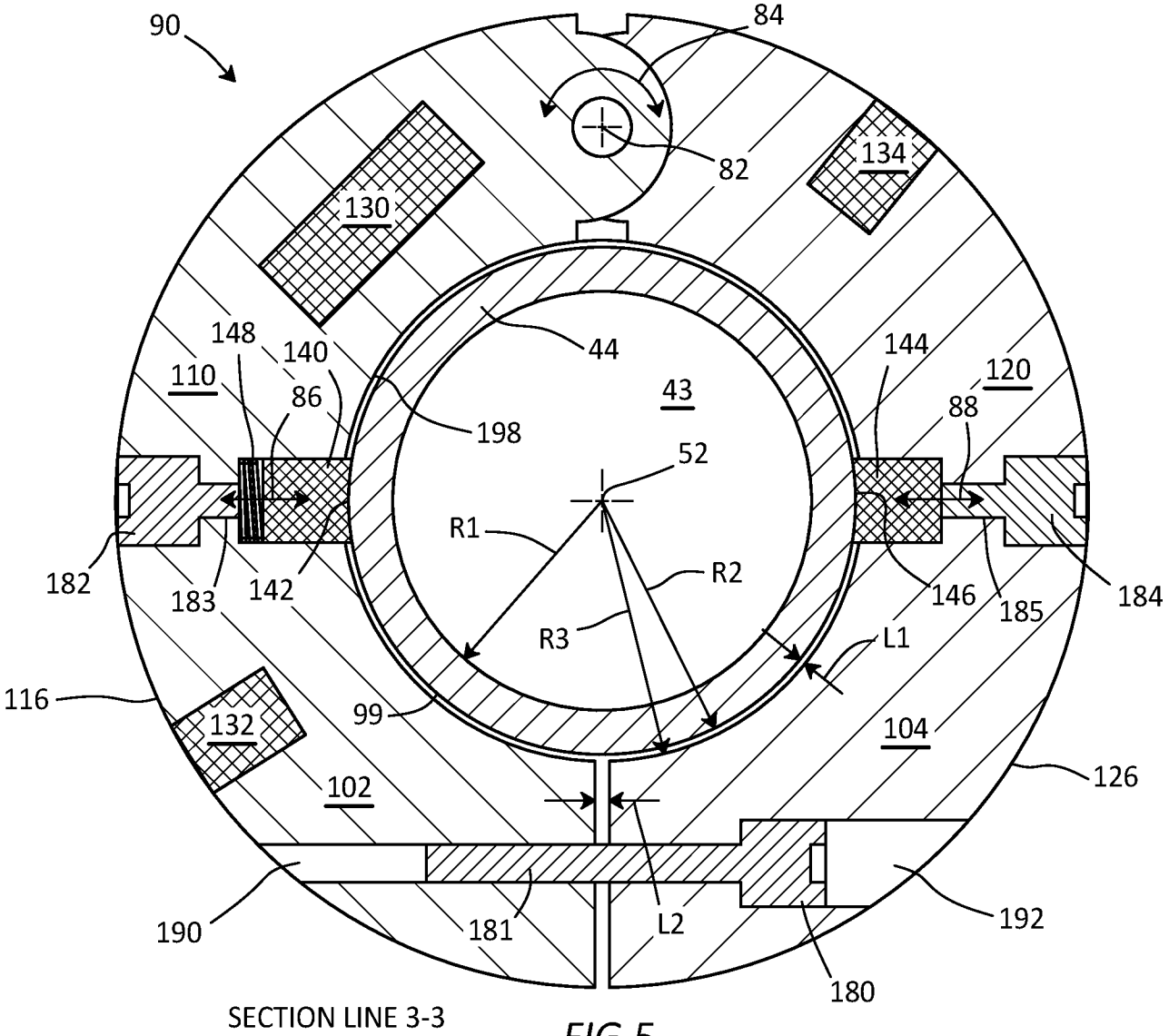
FIGS. 5-7 are representative partial cross-sectional view of various embodiments of a bolt-on vibration sensor assembly, in accordance with certain embodiments.

FIG. 5 is a representative partial cross-sectional view generally along cross-section line 3-3 of a bolt-on sensor assembly 100, according to one or more embodiments. The tool assembly 90 shown in FIG. 5 is very similar to the one shown in FIG. 3, except that each of the sensors 140, 144 has an associated fastener 182, 184 that can be used to radially retract or extend the respective sensor 140, 144 into or away from the surface 198 of the sensor assembly 100. After the segments 110, 120 are rotated to the closed position and removably secured together by fastener 180, the fastener 182 with threads 183 can be used to radially extend (arrows 86) the sensor 140 toward the surface 99 of the sub 44 by rotating the fastener 182 in one direction and radially retracting the sensor 140 away from the surface 99 by rotating the fastener 182 in a second and opposite direction. The fastener 184 with threads 185 can be used to radially extend (arrows 88) the sensor 144 toward the surface 99 of the sub 44 by rotating the fastener 184 in one direction or radially retract the sensor 144 away from the surface 99 by rotating the fastener 184 in a second and opposite direction.

The compression of the sensors 140, 144 on the sub 44 at engagements 142, 146 can be controlled by controlling torque applied to the fasteners 182, 184. In this configuration, one of the sensors 140, 144 can be extended a desired distance past the innermost surface 198 of the sensor assembly 100, and then the other one of the sensors 140, 144 can be extended past the innermost surface 198 until contacting the sub at the respective engagement 142, 146, which would cause both sensors 140, 144 to engage the sub 44. Applying a desired torque on one of the fasteners 182, 184 can result in an equal compression force being applied by both sensors 140, 144 to the sub 44. It should be noted that the sensor 140 is equipped with a biasing device 148 (explained above) while the other sensor 144 is not equipped with a biasing device 149. This is merely given to show that the sensors 140, 144 may or may not include a biasing device and still provide desired performance for the sensor assembly 100.

Figure 6:
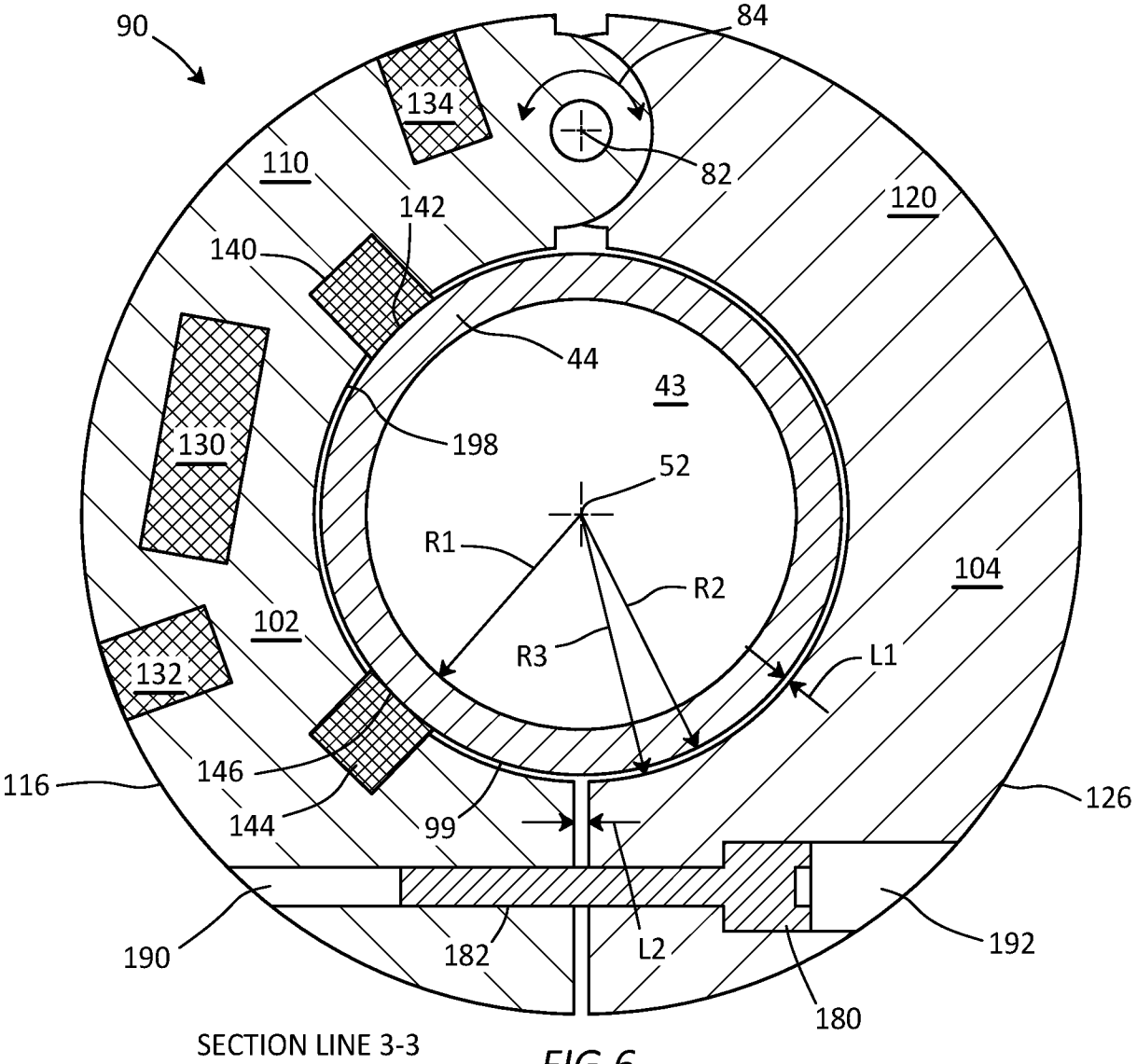

FIG. 6 is a representative partial cross-sectional view generally along cross-section line 3-3 of a bolt-on sensor assembly 100, according to one or more embodiments. The tool assembly 90 shown in FIG. 6 is very similar to the one shown in FIG. 3, except that the electronics 130, the antenna 132, the power source 134, and the two sensors 140, 144 are all housed in one of the arcuate segments 110, with the other segment 120 not being used to house items of the sensor assembly 100. As shown, the two sensors 140, 144 are circumferentially spaced away from each other, yet they remain positioned in the same segment 110. It should be understood that the sensor assembly 100 items could be housed in the segment 120 with segment 110 not containing any of the items. This can reduce manufacturing costs for the sensor assembly 100 by simplifying the fabrication of one of the segments 110, 120. It should be noted that the gap L1 on the right side of the sub 44 in this configuration will most likely be "0" zero, since the two sensors 140, 144 will be engaged on the left side of the sub 44 thereby forcing the sensor assembly 100 to be offset to the left relative to the sub 44 due to an asymmetric inner profile of the sensor assembly 100. In any event, this configuration can ensure that the sensors 140, 144 properly engage the sub 44 for detecting the signals 80. In any of the tool 90 embodiments, the tool 90 can be balanced based on rotation of the tool about the axis 52. Therefore, any offset to the left in FIG. 6 can be compensated for weight distribution around the axis 52 to provide balance in rotation when in use.

Figure 7:
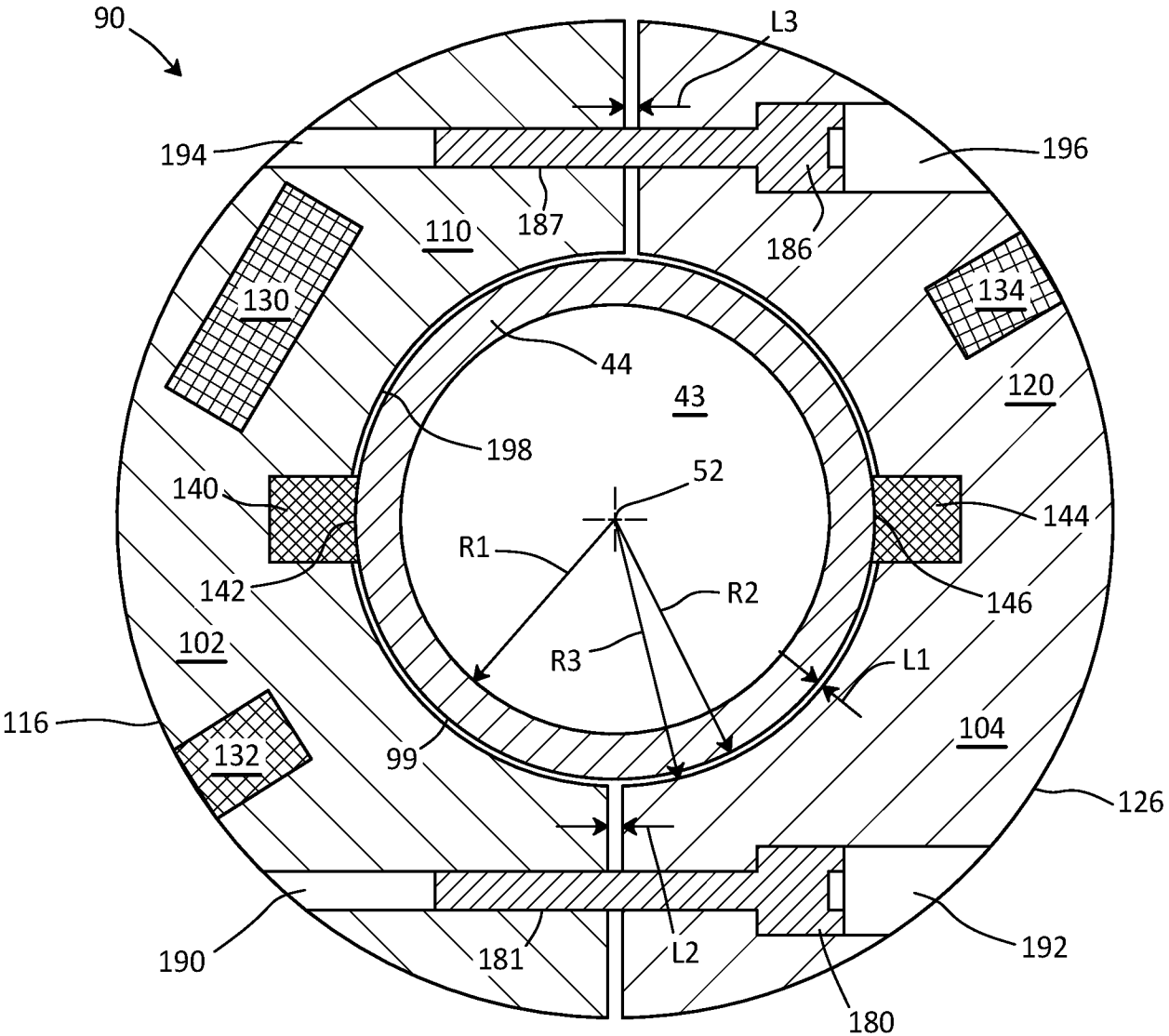

FIG. 7 is a representative partial cross-sectional view generally along cross-section line 3-3 of a bolt-on sensor assembly 100, according to one or more embodiments. The tool assembly 90 shown in FIG. 7 is very similar to the one shown in FIG. 3, except that the segments 110, 120 are not rotationally attached at the pivot 82. Instead, they are shown as two separate segments that are removably attached to each other via the fasteners 180, 186. Attaching the segments 110, 120 with the fasteners 180, 186 can form a circular sensor assembly 100 that surrounds the sub 44 in a closed position. The sensor assembly 100 can also be axially retained on the sub 44 by the upper and lower retainer rings 200, 210 or the snap ring retainers 230, 240. The sensors 140, 144 are engaged with the sub 44 at engagements 142, 146 when the sensor assembly 100 is the closed position and removably attached to the sub 44. The compression force of the sensors 140, 144 acting on the sub can be controlled by torque applied to the fasteners 180, 186. It should be understood that biasing devices 148, 149 (not shown) can be used with the sensors 140, 144 as in some of the previous embodiments. A gap L3 may remain between the segments 110, 120 when the fastener 186 is threadably attached to the segment 110 through the opening 196 in the segment 120. The gap L3, as well as the gap L2, can ensure that the torque applied to the fasteners 180, 186 is applied to the sensors 140, 144, instead of between the segments 110, 120.

Figure 8:
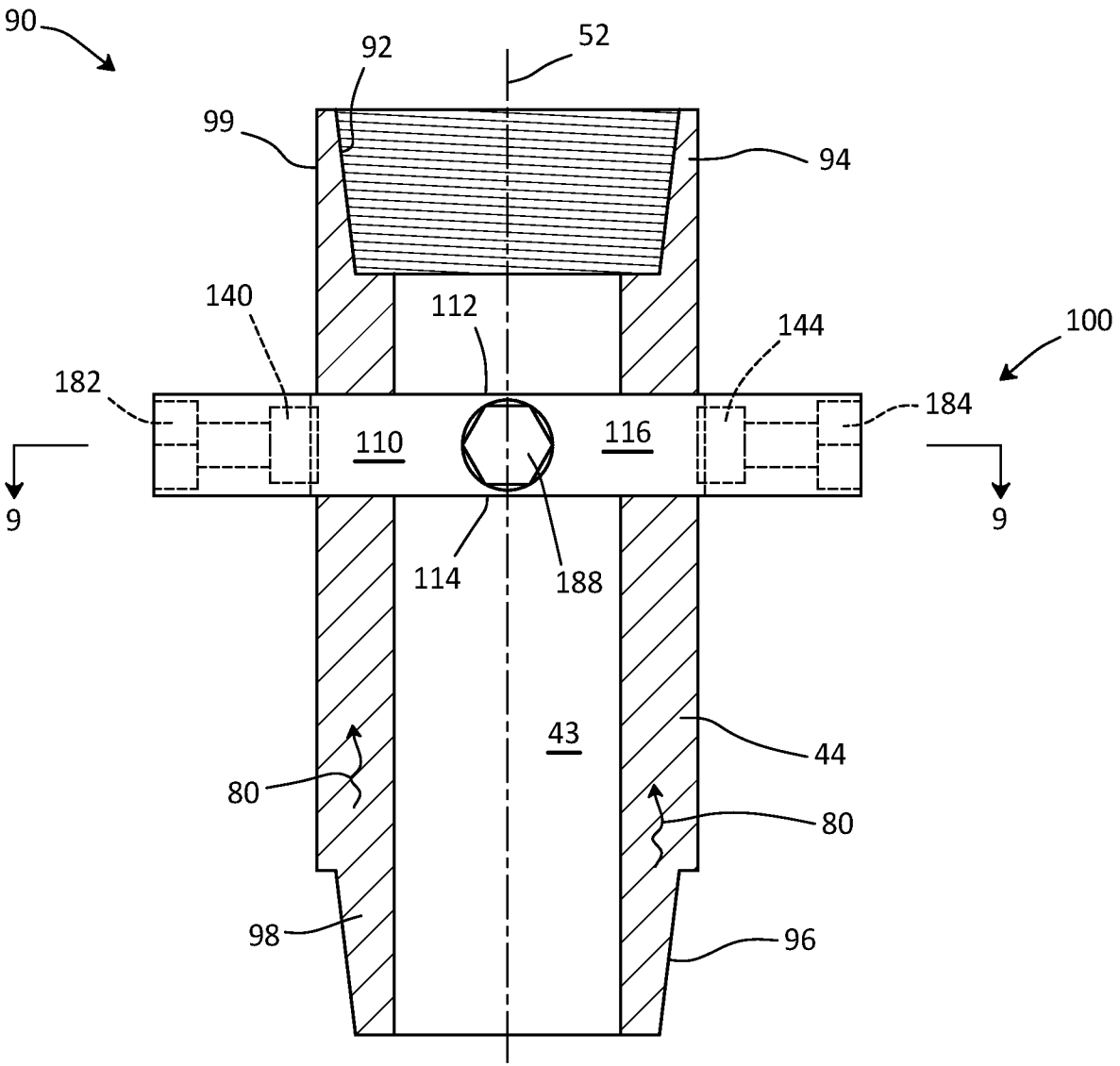
FIG. 8 is a representative partial cross-sectional view of another sub with a bolt-on vibration sensor assembly, in accordance with certain embodiments.

FIG. 8 is a representative partial cross-sectional view of a tool assembly 90 that can include a sub 44 with a bolt-on sensor assembly 100. The sub 44 can include a box end 94 with internal threads 92 and a pin end 98 with external threads 96. The sub 44 can also include an internal flow passage 43 with a central axis 52 that can align with the central axis 48 of the tubular string 28. The threaded ends 94, 98 can be used to connect the sub in line with the top drive 40 and the tubular string 28. The sub 44 is merely one example of a tubular element that can be used to carry the sensor assembly 100 and transfer the signals 80 from the tubular string 28 to the sensor assembly 100. In this embodiment, the sensor assembly 100 can be formed as an integral circular ring, with a plurality of fasteners 188 used to removably attach it to the sub 44 without using the upper and lower retainer rings 200, 210 shown in FIG. 2 or the snap ring retainers 230, 240 shown in FIG. 4 to maintain an axial position of the sensor assembly 100 on the sub 44.

The threaded fastener 182 can be used to extend the sensor 140 into compression contact with the sub 44, and the threaded fastener 184 can be used to extend the sensor 144 into compression contact with the sub 44, with the fasteners 182, 184 installed through the outer surface 116 of the sensor assembly 100 and into a threaded bore.

Figure 9:
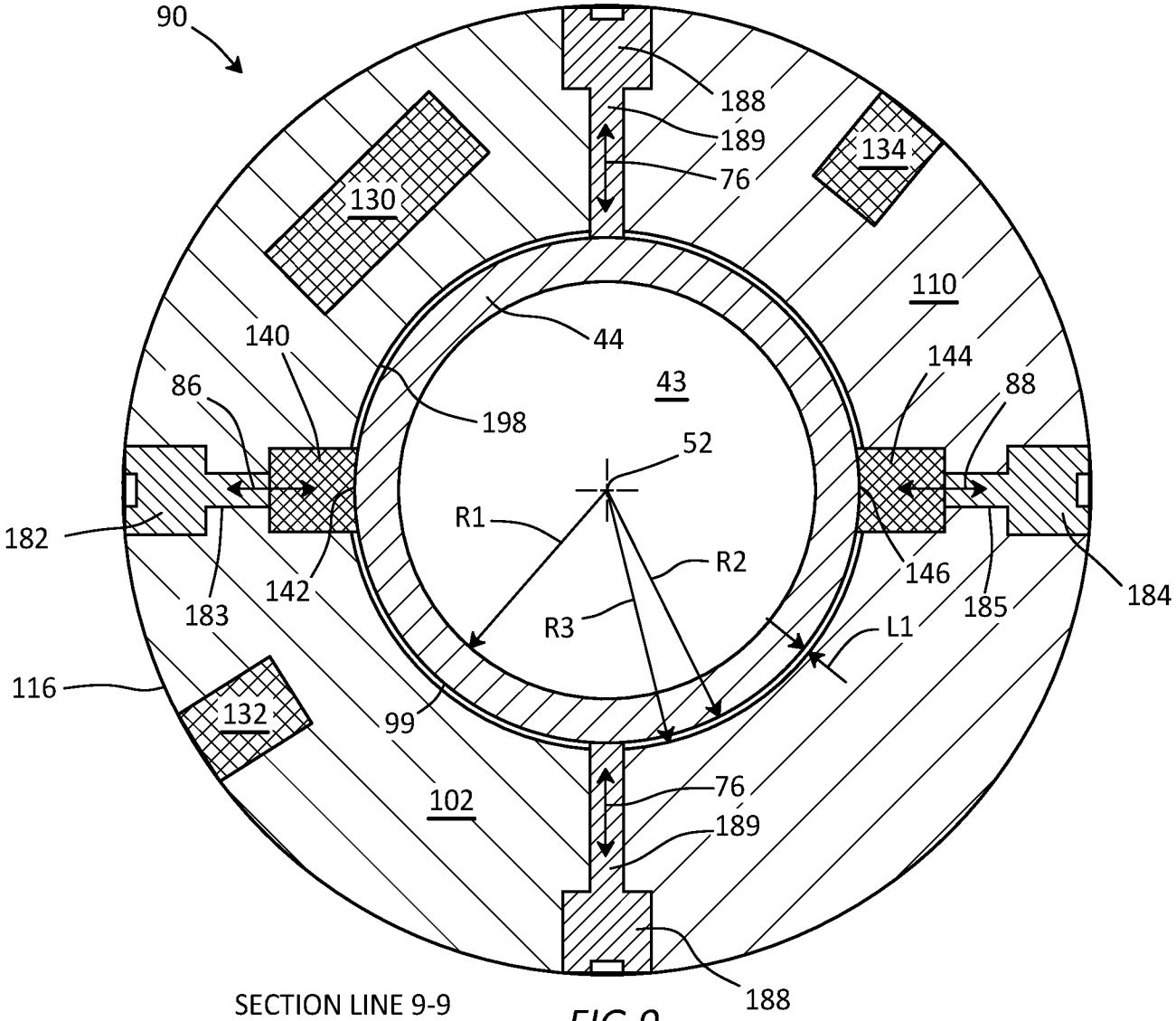
FIGS. 9-10 are representative partial cross-sectional view of various embodiments of a bolt-on vibration sensor assembly, in accordance with certain embodiments.

FIG. 9 is a representative partial cross-sectional view generally along cross-section line 9-9 of a tool assembly 90 shown in FIG. 8, according to one or more embodiments. The tool assembly 90 can include the sub 44 and the sensor assembly 100. The sensor assembly 100 can include a single integral circular ring 110. The circular ring 110 can be slid on to the sub 44 from either end and positioned at a desired axial location along the sub 44. At the desired axial location, the fasteners 188, with threads 189, can be threaded into the circular ring 110 to engage the outer surface 99 of the sub 44 as shown. Rotating each fastener 188 in one direction can extend the fastener 188 (arrows 76) toward the sub 44 and rotating each fastener 188 in an opposite direction can retract the fastener 188 (arrows 76) away from the sub 44. The fasteners 188 can selectively engage the sub 44 and retain the sensor assembly 100 at the desired axial location on the sub 44 when they are engaged with the sub 44.

The sensors 140, 144 can have an associated fastener 182, 184 that can be used to radially retract and extend the respective sensor 140, 144 into and from the surface 198 of the sensor assembly 100. After the circular ring 110 is positioned at the desired axial location on the sub 44 and the fasteners 188 are used to secure the sub 44 at the axial location, the fastener 182 with threads 183 can be used to radially extend (arrows 86) the sensor 140 toward the surface 99 of the sub 44 by rotating the fastener 182 in one direction and radially retracting the sensor 140 away from the surface 99 by rotating the fastener 182 in a second and opposite direction. The fastener 184 with threads 185 can be used to radially extend (arrows 88) the sensor 144 toward the surface 99 of the sub 44 by rotating the fastener 184 in one direction and radially retracting the sensor 144 away from the surface 99 by rotating the fastener 184 in a second and opposite direction.

The compression of the sensors 140, 144 on the sub 44 at engagements 142, 146 can be controlled by controlling torque applied to the fasteners 182, 184. In this configuration, one of the sensors 140, 144 can be extended a desired distance past the innermost surface 198 of the sensor assembly 100, and then the other one of the sensors 140, 144 can be extended past the innermost surface 198 until contacting the sub at the respective engagement 142, 146, which would cause both sensors 140, 144 to engage the sub 44. Applying a desired torque on one of the fasteners 182, 184 can result in an equal compression force being applied by both sensors 140, 144 to the sub 44. It should be noted that either or both of the sensors 140, 144 can be equipped with a biasing device 148, 149 (explained above).

The sensor assembly 100 can include electronics 130, one or more antennas 132, a power source 134, and one or more sensors 140, 144 housed in the circular ring 110. The sensors 140, 144 can detect the vibration or acoustic signals 80 transmitted from the downhole device 70, through the tubular string 28 to the sub 44. The sensors 140, 144 can be communicatively coupled to the electronics 130, which can receive sensor data from the sensors 140, 144 and can save the sensor data in a non-transitory memory. The electronics 130 can include one or more processors coupled to the non-transitory memory for storing the sensor data, processing the sensor data, or executing program instructions stored in the non-transitory memory.

The power source 134 can be configured to provide the necessary energy to power the electronics 130, the sensors 140, 144, and the one or more antennas 132. The power source 134 can be a battery (e.g., lithium-ion battery, etc.) or any other energy storage device that can be used to power the sensor assembly 100.

The one or more antennas 132 can be communicatively coupled to the one or more processors in the electronics 130 and can be used to wirelessly communicate to other rig equipment external to the sensor assembly 100 (such as top drive 40, rig controller 60, etc.). The sensors 140, 144 can be compressed into direct coupling or contact with the outer surface 99 of the sub 44. Direct engagement 142, 146 of the respective sensors 140, 144 to the sub 44 provide a direct transfer of the signals 80 to the sensors 140, 144 which can maximize sensitivity of the sensors 140, 144 to the signals 80 traveling in the sub 44.

The sub 44 can have in internal radius R1 relative to the central axis 52 and an external radius R2 relative to the central axis 52. The sensor assembly 100, when removably attached to the sub 44 can have an internal radius R3. The difference between the radius R2 and the radius R3 can be represented as a gap L1. The gap L1 is between the outer surface 99 of the sub 44 and the innermost surface 198 of the sensor assembly 100. The sensors 140, 144 can extend radially inward toward central axis 52 past the innermost surface 198 of the sensor assembly 100. Therefore, when the circular ring 110 is installed on the sub 44, the fasteners 188 can be installed to maintain the sensor assembly 100 in the desired axial position on the sub 44. The sensors 140, 144 engage the sub 44 at respective engagements 142, 146 by being extended from the sensor assembly 100 through the gap L1 and into engagement with the outer surface 99 of the sub 44. As stated above, the direct contact or coupling of the sensors 140, 144 to the sub 44 provides maximum sensitivity to the transfer of the signals 80 from sub 44 to the sensors 140, 144.

Even though biasing devices may not be required, the sensors 140, 144 can each have a biasing device 148, 149, respectively, that can ensure maximum compression of the sensors 140, 144 against the sub 44 at the engagements 142, 146 and help prevent exceeding a maximum compression of the sensors 140, 144 against sub 44. The biasing devices 148, 149 can be made of materials that maintain a sensitivity of the sensors 140, 144 against the sub 44. It should be understood that the biasing devices 148, 149 are not required and the sensors 140, 144 can be installed in the circular ring 110 such that they extend from the innermost surface 198 of the sensor assembly 100 to engage the sub 44, with the torque applied to the fasteners 188 is used to control compression forces of the sensors 140, 144 against the sub 44.

Figure 10:
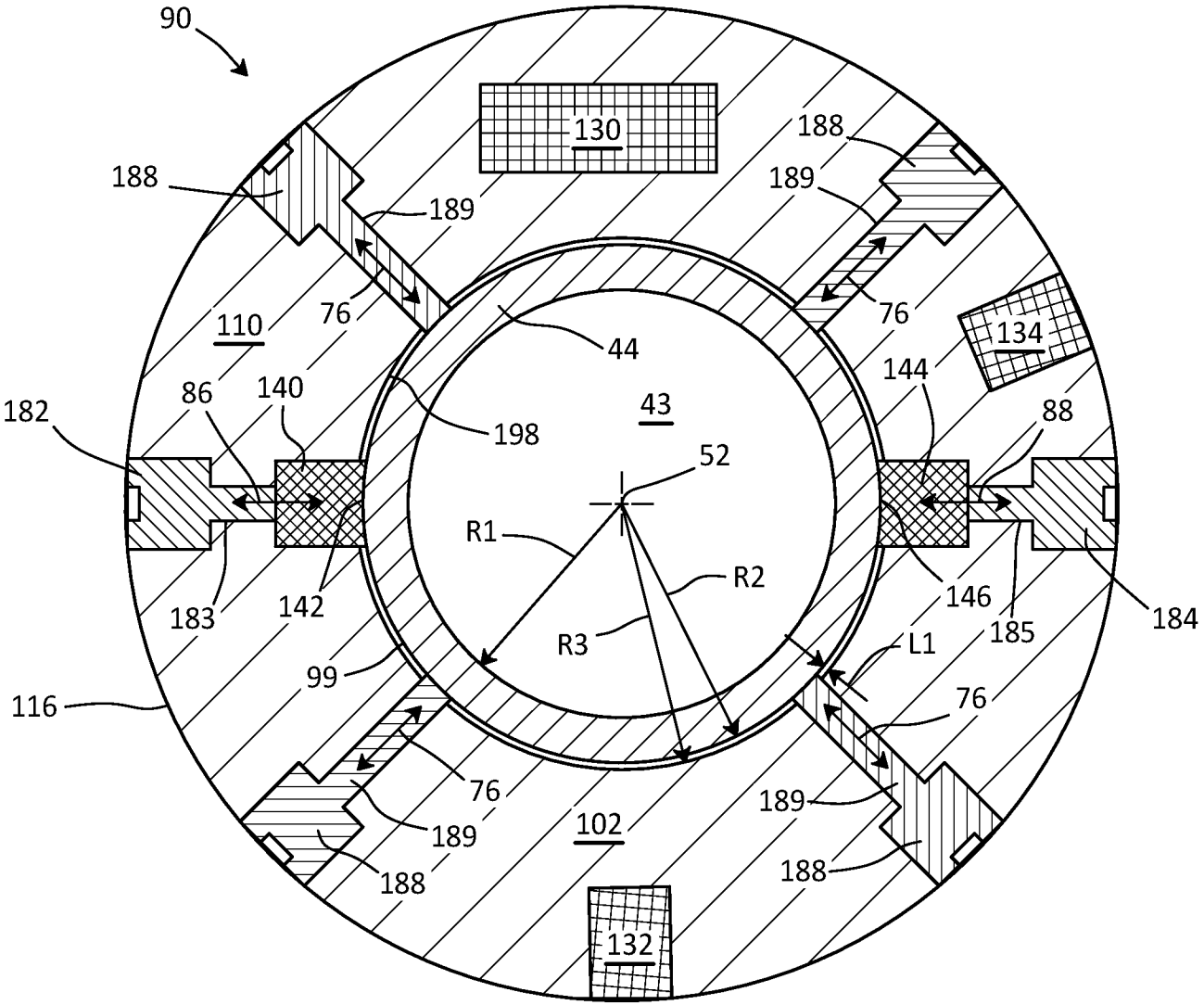

FIG. 10 is a representative partial cross-sectional view generally along cross-section line 9-9 of a tool assembly 90 shown in FIG. 8, according to one or more embodiments. The tool assembly 90 in FIG. 10 is very similar to the tool assembly 90 in FIG. 9 except that two additional fasteners 188 are included to removably secure the sensor assembly 100 at the desired axial location on the sub 44. The fasteners 188 can be circumferentially spaced around the circular ring 110 to provide the necessary retaining force to maintain the sensor assembly 100 at the desired axial location, when the fasteners 188 are engaged with the sub 44. It should be understood that more or fewer fasteners 188 can be used to removably secure the sensor assembly 100 to the sub 44. For example, three fasteners 188 can be used instead of two or four as shown in the figures.

Various Embodiments

Embodiment 1. A system for detecting vibration signals in subterranean operations, the system comprising:

a tool assembly comprising:

a vibration sensor assembly, the vibration sensor assembly comprising:

one or more sensors that are configured to detect vibration signals transmitted through a tubular string, wherein the one or more sensors extend radially inward past an innermost surface of the vibration sensor assembly.

Embodiment 2. The system of embodiment 1, wherein the tool assembly further comprises a sub, with the vibration sensor assembly being configured to be removably attached to an outer surface of the sub, and wherein the one or more sensors are configured to engage the outer surface of the sub.

Embodiment 3. The system of embodiment 2, wherein the one or more sensors include a biasing device between a body of the vibration sensor assembly and the one or more sensors that engage the sub.

Embodiment 4. The system of embodiment 2, wherein a fastener is threadably engaged with a body of the vibration sensor assembly, wherein the fastener is configured to radially extend one of the one or more sensors into engagement with the outer surface of the sub or radially retract the one of the one or more sensors out of engagement with the outer surface of the sub.

Embodiment 5. The system of embodiment 2, wherein the vibration sensor assembly further comprises electronics, an antenna, and a power source disposed in one or more segments of the vibration sensor assembly.

Embodiment 6. The system of embodiment 5, wherein the electronics are communicatively coupled to the one or more sensors and the antenna, wherein the electronics are configured to receive sensor data from the one or more sensors and transmit representative data wirelessly, via the antenna, to equipment external to the vibration sensor assembly, and wherein the representative data is representative of the sensor data.

Embodiment 7. The system of embodiment 5, wherein the electronics comprise one or more processors and non-transitory memory, wherein one or more processors store sensor data from the one or more sensors in the non-transitory memory, and wherein the one or more processors retrieve the sensor data from the non-transitory memory and wirelessly transmit the sensor data to equipment external to the vibration sensor assembly.

Embodiment 8. The system of embodiment 2, wherein the vibration sensor assembly comprises a first arcuate segment and a second arcuate segment, with the first arcuate segment rotationally attached to the second arcuate segment at one end and with another end of the first arcuate segment being configured to receive a fastener that is installed through an opening in the second arcuate segment.

Embodiment 9. The system of embodiment 8, wherein the fastener, when installed, causes the first arcuate segment to rotate toward the second arcuate segment such that the one or more sensors engage the outer surface of the sub.

Embodiment 10. The system of embodiment 9, wherein an upper retainer ring is positioned above the vibration sensor assembly and a lower retainer ring is positioned below the vibration sensor assembly, and wherein the upper retainer ring and the lower retainer ring cooperate to retain the vibration sensor assembly at a desired axial location along the sub.

Embodiment 11. The system of embodiment 10, wherein an adjustment ring is threadably connected to a portion of the lower retainer ring, and wherein rotating the adjustment ring relative to the portion of the lower retainer ring in a first direction moves the adjustment ring toward a bottom surface of the vibration sensor assembly and rotating the adjustment ring relative to the portion of the lower retainer ring in a second direction that is opposite the first moves the adjustment ring away from a bottom surface of the vibration sensor assembly.

Embodiment 12. The system of embodiment 11, wherein rotating the adjustment ring in the first direction applies a compression force to the bottom surface of the vibration sensor assembly while the upper retainer ring applies an equal and opposite compression force to an upper surface of the vibration sensor assembly, and wherein the compression forces secure the vibration sensor assembly at the desired axial location along the sub.

Embodiment 13. The system of embodiment 2, wherein the vibration sensor assembly comprises a first arcuate segment and a second arcuate segment, with a first end of the first arcuate segment being configured to receive a first fastener that is installed through a first opening in a first end of the second arcuate segment, and wherein the first fastener removably secures the first ends of the first and second arcuate segments together when the first fastener is installed.

Embodiment 14. The system of embodiment 13, wherein a second end of the first arcuate segment is configured to receive a second fastener that is installed through a second opening in a second end of the second arcuate segment, and wherein the second fastener removably secures the second ends of the first and second arcuate segments together when the second fastener is installed.

Embodiment 15. The system of embodiment 2, wherein the vibration sensor assembly comprises an integral circular ring, wherein at least one fastener is threadably engaged with the integral circular ring, wherein rotation of the fastener in a first direction extends the fastener toward the sub, and rotation of the fastener in a second and opposite direction retracts the fastener away from the sub.

Embodiment 16. The system of embodiment 15, wherein the fastener is configured to retain the vibration sensor assembly at a desired axial location along the sub when the fastener engages the sub.

Embodiment 17. A method for detecting vibration signals in subterranean operations, the method comprising:

removably attaching a vibration sensor assembly to a sub proximate a top end of a tubular string in a wellbore;

radially extending one or more sensors of the vibration sensor assembly past an innermost surface of the vibration sensor assembly toward the sub;

engaging the one or more sensors with an outer surface of the sub; and detecting vibration signals carried by the tubular string via the one or more sensors.

Embodiment 18. The method of embodiment 17, further comprising:

receiving vibration signals into the tubular string from various sources;

transmitting the vibration signals through the tubular string; and wirelessly transmitting representative data to equipment external to the vibration sensor assembly, wherein the representative data is representative of the vibration signals detected by the one or more sensors.

Embodiment 19. The method of embodiment 17, wherein removably attaching further comprises:

rotating first and second segments of the vibration sensor assembly into a closed position that encircles the sub; and installing a fastener that maintains the vibration sensor assembly in the closed position.

Embodiment 20. The method of embodiment 17, wherein radially extending further comprises:

selectively rotating in a first direction a fastener that is coupled to one of the one or more sensors, thereby radially extending the sensor toward the sub and relative to a body of the vibration sensor assembly; and selectively rotating the fastener in a second direction thereby radially retracting the sensor away from the sub and relative to the body of the vibration sensor assembly.

Embodiment 21. The method of embodiment 17, further comprising:

retaining the vibration sensor assembly at an axial position on the sub by installing an upper retaining ring on the sub above the vibration sensor assembly and installing a lower retaining ring on the sub below the vibration sensor assembly;

rotating an adjustment ring of the lower retaining ring; and compressing the vibration sensor assembly between the lower retainer ring and the upper retainer ring, thereby retaining the vibration sensor assembly at the axial position on the sub.

Embodiment 22. The method of embodiment 17, wherein removably attaching comprises:

sliding an integral circular ring over an end of the sub;

installing at least a first threaded fastener radially through the integral circular ring; and engaging the sub with the first threaded fastener, thereby retaining the vibration sensor assembly at an axial position on the sub.

Embodiment 23. The method of embodiment 22, further comprising:

installing a second threaded fastener radially into the integral circular ring, thereby engaging one of the one or more sensors;

selectively rotating in a first direction the second threaded fastener, thereby radially extending the sensor toward the sub and from a body of the vibration sensor assembly; and selectively rotating the second threaded fastener in a second direction thereby radially retracting the sensor away from the sub and into the body of the vibration sensor assembly.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for detecting vibration signals in subterranean operations, the system comprising:

a tool assembly comprising:

a vibration sensor assembly, the vibration sensor assembly comprising:

one or more sensors that are configured to detect vibration signals transmitted through a tubular string, wherein the one or more sensors extend radially inward through an innermost surface of the vibration sensor assembly, and wherein the innermost surface is an inner cylindrical surface of the vibration sensor assembly that is closest to a central axis of the vibration sensor assembly, and wherein the vibration sensor assembly is configured to rotate with the tubular string when the tubular string is rotated.

2. The system of claim 1, wherein the tool assembly further comprises a sub, with the vibration sensor assembly being configured to be removably attached to an outer surface of the sub, and wherein the one or more sensors are configured to engage the outer surface of the sub.

3. The system of claim 2, wherein the one or more sensors include a biasing device between a body of the vibration sensor assembly and the one or more sensors that engage the sub.

4. The system of claim 2, wherein a fastener is threadably engaged with a body of the vibration sensor assembly, wherein the fastener is configured to radially extend one of the one or more sensors into engagement with the outer surface of the sub or radially retract the one of the one or more sensors out of engagement with the outer surface of the sub.

5. The system of claim 2, wherein the vibration sensor assembly further comprises electronics, an antenna, and a power source disposed in one or more segments of the vibration sensor assembly.

6. The system of claim 5, wherein the electronics are communicatively coupled to the one or more sensors and the antenna, wherein the electronics are configured to receive sensor data from the one or more sensors and transmit representative data wirelessly, via the antenna, to equipment external to the vibration sensor assembly, and wherein the representative data is representative of the sensor data.

7. The system of claim 5, wherein the electronics comprise one or more processors and non-transitory memory, wherein one or more processors store sensor data from the one or more sensors in the non-transitory memory, and wherein the one or more processors retrieve the sensor data from the non-transitory memory and wirelessly transmit the sensor data to equipment external to the vibration sensor assembly.

8. The system of claim 2, wherein the vibration sensor assembly comprises a first arcuate segment and a second arcuate segment, with the first arcuate segment rotationally attached to the second arcuate segment at one end and with another end of the first arcuate segment being configured to receive a fastener that is installed through an opening in the second arcuate segment.

9. The system of claim 8, wherein the fastener, when installed, causes the first arcuate segment to rotate toward the second arcuate segment such that the one or more sensors engage the outer surface of the sub.

10. The system of claim 9, wherein an upper retainer ring is positioned above the vibration sensor assembly and a lower retainer ring is positioned below the vibration sensor assembly, and wherein the upper retainer ring and the lower retainer ring cooperate to retain the vibration sensor assembly at a desired axial location along the sub.

11. The system of claim 2, wherein the vibration sensor assembly comprises a first arcuate segment and a second arcuate segment, with a first end of the first arcuate segment being configured to receive a first fastener that is installed through a first opening in a first end of the second arcuate segment, and wherein the first fastener removably secures the first ends of the first and second arcuate segments together when the first fastener is installed.

12. The system of claim 11, wherein a second end of the first arcuate segment is configured to receive a second fastener that is installed through a second opening in a second end of the second arcuate segment, and wherein the second fastener removably secures the second ends of the first and second arcuate segments together when the second fastener is installed.

13. The system of claim 2, wherein the vibration sensor assembly comprises an integral circular ring, wherein at least one fastener is threadably engaged with the integral circular ring, wherein rotation of the fastener in a first direction extends the fastener toward the sub, and rotation of the fastener in a second and opposite direction retracts the fastener away from the sub.

14. A method for detecting vibration signals in subterranean operations, the method comprising:

removably attaching a vibration sensor assembly to a sub proximate a top end of a tubular string in a wellbore;

radially extending one or more sensors of the vibration sensor assembly through an innermost surface of the vibration sensor assembly toward the sub, and wherein the innermost surface is an inner cylindrical surface of the vibration sensor assembly that is closest to a central axis of the vibration sensor assembly;

engaging the one or more sensors with an outer surface of the sub;

rotating the vibration sensor assembly along with the tubular string; and detecting vibration signals carried by the tubular string via the one or more sensors.

15. The method of claim 14, further comprising:

receiving vibration signals into the tubular string from various sources;

transmitting the vibration signals through the tubular string; and wirelessly transmitting representative data to equipment external to the vibration sensor assembly, wherein the representative data is representative of the vibration signals detected by the one or more sensors.

16. The method of claim 14, wherein removably attaching further comprises:

rotating first and second segments of the vibration sensor assembly into a closed position that encircles the sub; and installing a fastener that maintains the vibration sensor assembly in the closed position.

17. The method of claim 14, wherein radially extending further comprises:

selectively rotating in a first direction a fastener that is coupled to one of the one or more sensors, thereby radially extending the one of the one or more sensors toward the sub and relative to a body of the vibration sensor assembly; and selectively rotating the fastener in a second direction thereby radially retracting the one of the one or more sensors away from the sub and relative to the body of the vibration sensor assembly.

18. The method of claim 14, further comprising:

retaining the vibration sensor assembly at an axial position on the sub by installing an upper retaining ring on the sub above the vibration sensor assembly and installing a lower retaining ring on the sub below the vibration sensor assembly;

rotating an adjustment ring of the lower retaining ring; and compressing the vibration sensor assembly between the lower retaining ring and the upper retaining ring, thereby retaining the vibration sensor assembly at the axial position on the sub.

19. The method of claim 14, wherein removably attaching comprises:

sliding an integral circular ring over an end of the sub;

installing at least a first threaded fastener radially through the integral circular ring; and engaging the sub with the first threaded fastener, thereby retaining the vibration sensor assembly at an axial position on the sub.

20. The method of claim 19, further comprising:

installing a second threaded fastener radially into the integral circular ring, thereby engaging one of the one or more sensors;

selectively rotating in a first direction the second threaded fastener, thereby radially extending the one of the one or more sensors toward the sub and from a body of the vibration sensor assembly; and selectively rotating the second threaded fastener in a second direction thereby radially retracting the one of the one or more sensors away from the sub and into the body of the vibration sensor assembly.

* * * * *